United States Patent [19]

Rodabaugh

[11] 3,961,575

[45] June 8, 1976

[54] PRINTING APPARATUS FOR USE ON PLASTIC CONTAINERS

[76] Inventor: Rowena Ann Rodabaugh, 10110 Sepulveda No. 27, Mission Hills, Calif. 91340

[22] Filed: Apr. 12, 1974

[21] Appl. No.: 460,587

[52] U.S. Cl. ..... 101/9; 101/31

[51] Int. Cl.[2] ..... B44B 5/02; B41F 17/20

[58] Field of Search ..... 101/9, 10, 11, 27, 31, 101/21, 25, DIG. 4

[56] References Cited

UNITED STATES PATENTS

| | | | |
|---|---|---|---|
| 1,928,067 | 9/1933 | Martoccio | 101/31 X |
| 2,711,095 | 6/1955 | Harper | 101/27 X |
| 2,751,701 | 6/1956 | Grupe | 101/11 |
| 3,002,447 | 10/1961 | Haugh | 101/4 |
| 3,195,450 | 7/1965 | Sciame | 101/9 |
| 3,229,401 | 1/1966 | Sobran | 101/9 X |
| 3,313,919 | 4/1967 | Richardson et al. | 219/433 |
| 3,411,438 | 11/1968 | Reader et al. | 101/9 |
| 3,478,680 | 11/1969 | Anderson, Jr. | 101/9 X |
| 3,566,784 | 3/1971 | Mitter | 101/120 |
| 3,613,570 | 10/1971 | Gladen | 101/9 |

*Primary Examiner*—Clifford D. Crowder

[57] ABSTRACT

A printing apparatus having a back plate integrally connected to a ram capable of reciprocating or being stationary. The back plate has a surface that corresponds to the printing surface. A die carrying indicia is made to adjust to the contour of the printing surface automatically by use of spring bias means or resilient padding. Insert heaters are connected to each die. They allow flexibility of design and provide each die and/or decoration with a constant differing heat. Therefore, printing and decorating can be done on various sizes and shapes of plastic surfaces in a variety of colors.

10 Claims, 2 Drawing Figures

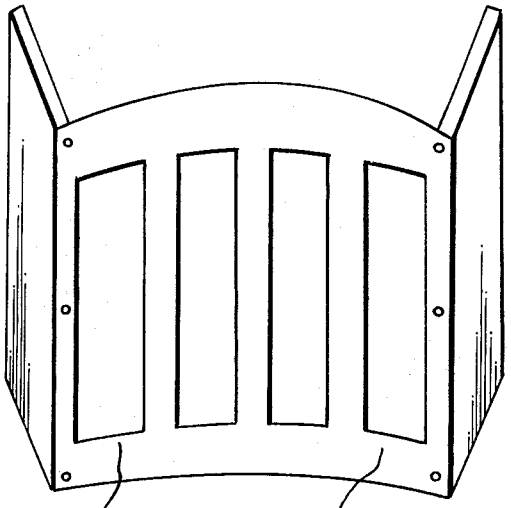
FIG. 4
FIG. 5
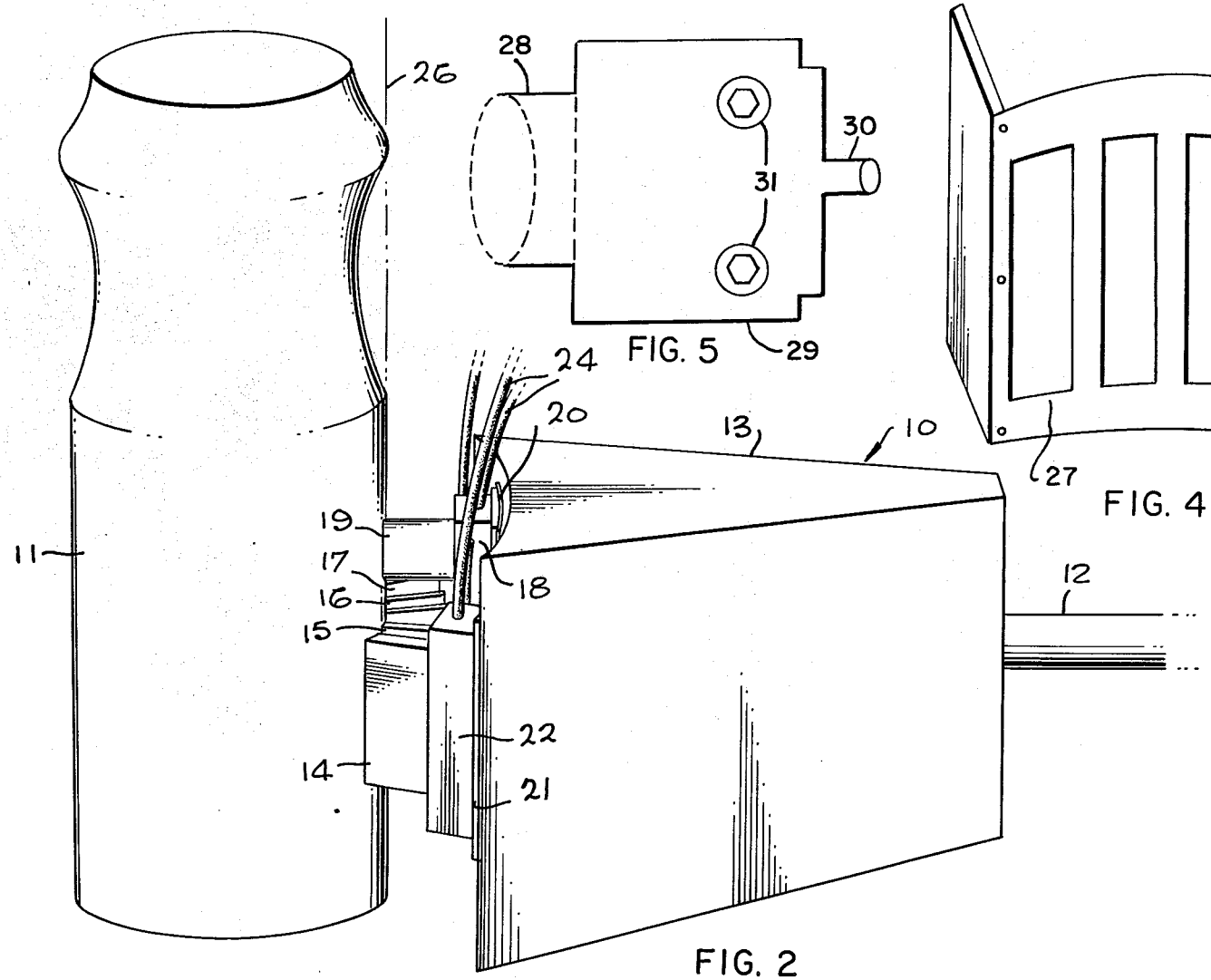
FIG. 2

PRINTING APPARATUS FOR USE ON PLASTIC CONTAINERS

BACKGROUND OF THE INVENTION

1. Field of the Invention

This invention relates to printing machines for labeling plastic containers, and, more particularly, to head construction for supporting the dies or markers. It can be used to decorate or mark plastic surfaces other than containers.

2. Description of the Prior Art

Prior printing machines usually include a reciprocable ram having a head located at its lower end for supporting a marker or die. An anvil is mounted in a suitable block beneath the head for retaining a workpiece in an operable position. A film having a layer of coating material, such as an alkali metal or marking pigment, is inserted between the marker and the workpiece. The marker or die is heated and functions to release the coating material depositing it on the surface of the workpiece. Although such devices are used extensively, they suffer various shortcomings severely limiting their utilization for container labeling. A major constraint of these machines is that they are relatively large and bulky, and usually operable on limited types of workpieces such as flat objects or plastic wire. Many plastic bottles and containers are unsuitable on such machines for assembly line production. The reason for the problem lies in the head construction of the apparatus. In prior devices the heads are rigidly mounted on the machine and are unable to function resiliently and automatically with the work piece, so as to conform to the configuration of the printing surface. As a result, upon contacting the workpiece, the dies do not adjust to the contour of the work piece nor compensate for any misalignment. Many bottles won't fit or go through the machine. Furthermore, prior devices did not have the capability of individually controlling the temperature of each of the dies which is undesirable because of the different heating characteristics of the various dies and color plates.

SUMMARY OF THE INVENTION

The invention described herein cures the above-mentioned inadequacies of prior devices by providing a printing apparatus that is self-adjusting and adaptable to many printing surfaces. The back plate or conformity is measured and made for the size and pattern container for mass labeling. The apparatus includes a back plate integrally connected to a ram. Each die may be mounted on a block containing a cartridge heater which can be individually, thermostatically controlled. The die is integrally connected to each heater enabling heat to be conducted thereto. The distance between the heating block and die surface (as well as a bit of insulation) protects the printing surface and prevents color waves between letters. The present invention, both as to its organization and manner of operation, together with further objects and advantages thereof, may best be understood by reference to the following description and accompanying drawing.

BRIEF DESCRIPTION OF THE DRAWING

FIG. 2 is a side perspective view of the printing apparatus shown in FIG. 1, showing a container in printing position;

FIG. 4 shows a window framing die holder attachment; and

FIG. 5 shows a permanent magnet and holder attachment.

DESCRIPTION OF THE PREFERRED EMBODIMENT

Figure 3:
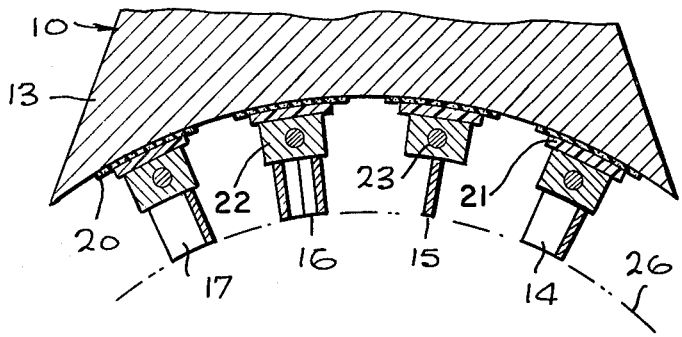
FIG. 3 shows a curved back conformity designed to meet a curved printing surface, and the insert heater position.
Figure 1:
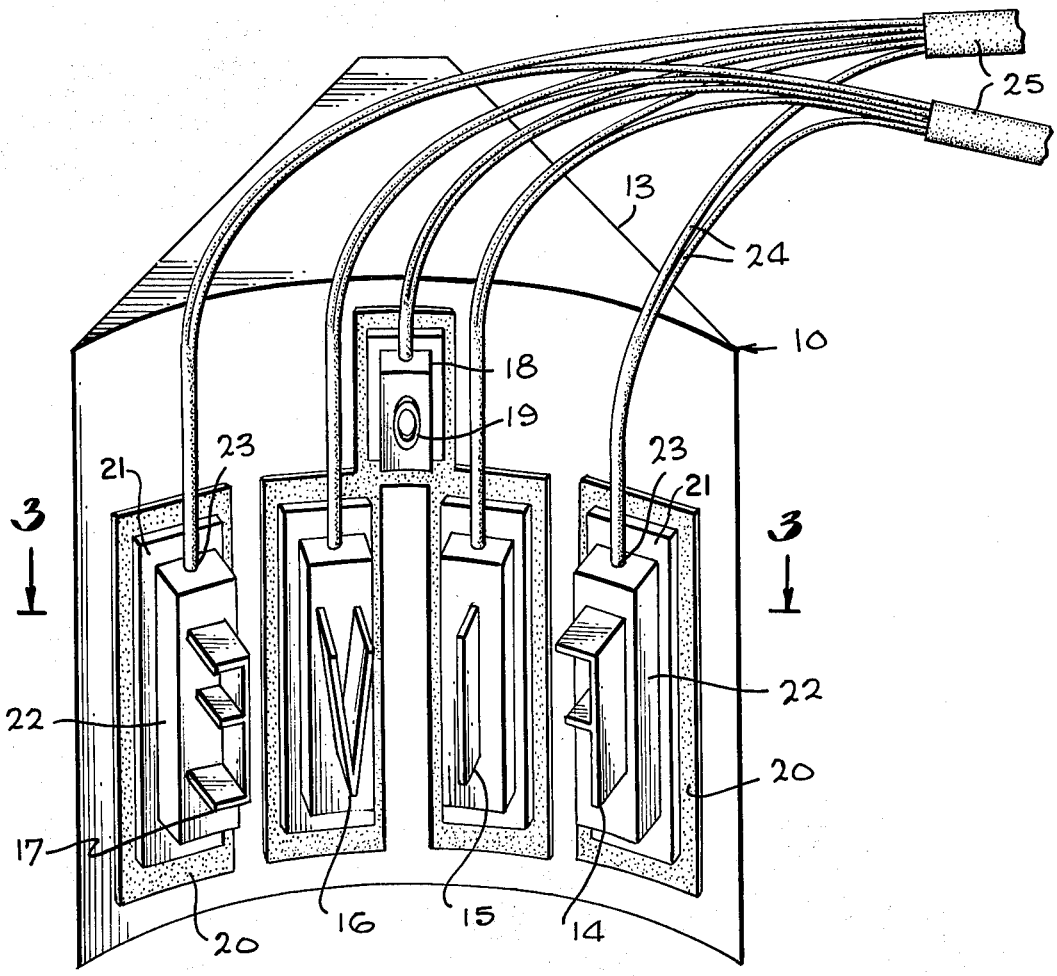
FIG. 1 is a front perspective view of the printing apparatus incorporating the present invention.

FIG. 1 shows a printing apparatus in the direction of arrow 10 for labeling a curved surface. A backing member in the form of a triangular aluminum back plate 13 yields stability. The curved aluminum front of the back plate 13 presenting a frontal surface has been measured and made the correct size for assembly line printing of a curved work piece in the form of the containers 11 having curved surfaces as illustrated. Die members such as dies 14, 15, 16, and 17 extend at radii from the back plate surface, each the same measured length to contact the printing surface correctly as herein after defined. A resilient member, e.g., a resilient padding 20 which is also flexible in its nature, for each die compensates for the minute differences in bottles made from the molds of a given size, the plastic surface itself and variation in alignment. An attachment above the line of printing is illustrated by 18. A decoration 19 can be placed away from the printing line. Cartridge heaters, or other forms of heater assemblies, 23 are shown inserted in each of the blocks 22. The leads, such as lead pair 24, of the heaters are connected to a temperature controller 25. Should the same temperature be desired for all die and decoration a variator only can be used. The flat surface dies are integrally attached to the heater blocks with silver solder and hence are in heat transfer relationship therewith.

FIG. 2 shows the same printing apparatus against a workpiece such as container 11. A sheet of printing material which may adopt the form of a web of cellophane 26 is coated with a heat sensitive material, that is a formula that prints on the plastic in the pattern and shape of the heated die surface and where the heat sensitive material is disposed toward the container. Foam rubber is used for the resilient padding 20 and there is an insulation member, such as a layer 21 of insulation between the heater block and the padding. Insulation is also used on top the heater blocks and contingent to the sides of the hot die. The workpiece featured here is a cylindrical plastic bottle the size of a typical cleanser bottle. A rod 12 operably connected to a motor, air cylinders, or other motive means (not shown) enables the printing device to reciprocate, and which rod 12 and air cylinder constitute a motive means. When the motive means moves the die member into registry with the work piece, it compresses a portion of the sheet of printing material into the work piece. Thus, the heated die member causes the area of heat sensitive material overlying the die member to be released from the sheet of printing material and disposed on the work piece. If it is desired to print both sides of the plastic surface at the same then two such apparatuses would be used simultaneously both operated automatically with the same motor timing.

An important advantage of the coupling is that its resiliency limits the amount of pressure exerted on the workpiece enabling the dies to orient to the contour of the bottle and to compensate for misalignment.

Individual thermostat control is important when different colors are used on the same workpiece simultaneously, because different color and design may require or optimally operate with different amounts of heat.

Another advantage is the adaptability of printing or decorating on different areas of a container at the same time by vertical or slanted pieces attached to the same back piece. A snowflake, star or other decoration, for examples, can be placed above the printing line and yet operate simultaneously with the letter die.

FIG. 4 shows a die holder attachment window framing each cartridge heater. The window frame die holder allows the die enough movement to adjust to the bottle but not enough movement in any direction to lose the alignment. The frame surrounding each heater block is denoted by No. 27.

FIG. 5 shows a permanent magnet No. 28 and holder attachment No. 29. Four of these are used, one on each side of the die member arrangement. The measured pull, permanent magnets have a screw adjustment at the back No. 30 and as the magnets are moved back or forward within the cases this serves to increase or decrease die pressure on a given side of the bottle. The holder attachment mounts as illustrated by No. 31.

It should be noted that various modifications, such as using other universal coupling means, or a different type of die holder or a support rod can be used while remaining within the purview of the following claims. Moreover, the dies can be attached in different positions to enable the apparatus to print or decorate on different spots on one surface simultaneously. The features of the present invention which are believed to be novel are set forth with particularity in the appended claims.

What is claimed is:

1. A printing device for applying indicia to the surface of a workpiece including a backing member having a frontal surface which generally conforms to the configuration of said surface of the workpiece, a resilient member attached to said frontal surface of the backing member, a heater assembly disposed upon and attached to said resilient member, insulation means interposed between said heater assembly and said resilient member, a rigid, permanent-configuration die member attached to said heater assembly and disposed in heat transfer relationship with said heater assembly, a sheet of printing material having on one side thereof a coating of heat sensitive material, said sheet of printing material being disposed between said die member and said workpiece with said coating being on the side adjacent said workpiece, and motive means for moving the die member into registry with said workpiece to compress a portion of said sheet of printing material against the workpiece, whereby the heated die member causes that area of heat sensitive material overlying the die member to be released from the sheet of printing material and to be deposited on the work piece and, whereby movement of said die members into engagement with the workpiece by said motive means causes an automatic alignment of said die members with the workpiece due to the presence of the resilient means.

2. The apparatus set forth in claim 1, wherein there are a plurality of resilient members, a like plurality of heater assemblies, and a like plurality of die members.

3. The apparatus set forth in claim 2, further including control means, operatively associated with each heater assembly for selecting and maintaining a heat for each heater assembly independently of the heat of the other heater assemblies.

4. The apparatus set forth in claim 2 wherein said heater assemblies each comprise a cartridge heater, at least one of said cartridge heaters being of a different size than the other of said cartridge heaters.

5. The apparatus set forth in claim 4, wherein the length of the die members is such as to space the workpiece a sufficient distance from the heater assemblies so that heat from the heater assemblies is essentially applied to the workpiece only through the die member.

6. The apparatus set forth in claim 5, wherein certain die members are aligned in a row adjacent one another, and wherein one or more of said die members other than said certain die members have indicia in the form of letters or decoration, and are located out of said row.

7. The apparatus set forth in claim 2, wherein said resilient member is a flexible pad.

8. The apparatus as set forth in claim 2, further including a die holder attachment secured on said backing member and being disposed around each of said heater assemblies for maintaining predetermined alignment of said die members while permitting limited movement of said die members to conform to the workpiece surface configuration.

9. The apparatus set forth in claim 1, wherein said motive means moves at least one die member at two or more sides of a work piece simultaneously and automatically.

10. The apparatus as set forth in claim 9 with magnetic means for mounting at the side of the die member to attract magnetic means mounted at the side of another die member on the other side of the workpiece to draw said die members toward each other with a constant pull during each printing operation.

* * * * *